US005655398A

United States Patent [19]

Ginzburg

[11] Patent Number: 5,655,398

[45] Date of Patent: Aug. 12, 1997

[54] ROLL CROSSING AND SHIFTING SYSTEM

[75] Inventor: Vladimir B. Ginzburg, Pittsburgh, Pa.

[73] Assignees: Danieli United, A Division of Danieli Corporation; International Rolling Mill Consultants, Inc., both of Pittsburgh, Pa.

[21] Appl. No.: 438,945

[22] Filed: May 11, 1995

[51] Int. Cl.[6] ..... B12B 31/07; B12B 31/18; B12B 13/14; B12B 29/00

[52] U.S. Cl. ..... 72/247; 72/241.8; 72/241.4

[58] Field of Search ..... 72/241.2, 241.4, 72/241.8, 247

[56] References Cited

U.S. PATENT DOCUMENTS

| | | |
|---|---|---|
| 1,860,931 | 5/1932 | Keller . |
| 4,037,450 | 7/1977 | Gilvar . |
| 4,453,393 | 6/1984 | Hino et al. . |
| 4,627,261 | 12/1986 | Schiller . |
| 4,658,621 | 4/1987 | Link et al. . |
| 4,770,021 | 9/1988 | Kobayashi et al. . |
| 4,803,877 | 2/1989 | Yano . |
| 4,813,259 | 3/1989 | Grocock et al. . |
| 4,898,014 | 2/1990 | Ginzburg et al. . |
| 5,365,764 | 11/1994 | Kajiwara et al. ..... 72/241.2 |

FOREIGN PATENT DOCUMENTS

| | | |
|---|---|---|
| 0 506 138 A1 | 9/1992 | European Pat. Off. . |
| 0 553 480 A2 | 4/1993 | European Pat. Off. . |
| 0 553 480 A3 | 4/1993 | European Pat. Off. . |
| 53-127353 | 11/1978 | Japan . |
| 61-259812 | 11/1986 | Japan . |
| 57 777 526 | 10/1993 | Japan . |
| 52 777 527 | 10/1993 | Japan . |
| 62-26304 | 8/1994 | Japan . |
| 70 60 310 | 3/1995 | Japan . |
| 544491 | 2/1977 | U.S.S.R. . |

*Primary Examiner*—Lowell A. Larson
*Assistant Examiner*—Rodney Butler
*Attorney, Agent, or Firm*—Armstrong, Westerman, Hattori, McLeland and Naughton

[57] ABSTRACT

Apparatus and method for roll crossing and shifting in which work roll chocks are mounted between Mae West blocks, the chocks and Mae West blocks being provided with opposed contact surfaces defining an angle β to the roll axis, whereby, when the rolls are axially shifted, the rolls also cross, through an angle α, due to forces acting on the chocks as they move along the contact surfaces of the Mae West blocks.

18 Claims, 13 Drawing Sheets

ROLL CROSSING AND SHIFTING SYSTEM

BACKGROUND

1. Field Invention

This invention relates to the axial shifting and crossing of work rolls in a hot or cold rolling mill, wherein, each roll chock is supported by a pair of Mae West blocks which are mounted in the mill housing. Between the chocks and the corresponding Mae West blocks there is defined a pair of contact surfaces whereby, during axial shifting of the work rolls, work roll chocks are caused to slide along the supporting Mae West blocks, thereby causing accompanying simultaneous crossing of the rolls as a result of movement of the roll chocks in a direction perpendicular to the roll axis.

2. Description of the Prior Art

In conventional rolling, with parallel, cylindrical rolls, the rolls wear unevenly along the roll barrel length. Also, deviations in roll configuration, due, for example, to uneven roll wear and distortions caused by thermal conditions to which the rolls are exposed, cause unwanted deviations from a desired flat condition of a workpiece, such as sheet or strip, being rolled. For example, such rolls develop edge grooves which produce ridges on the rolled workpiece.

The normal purposes of axial shifting of rolls in a rolling mill are (1) to control workpiece profile, and (2) to distribute roll wear more evenly.

One example of relatively new and advanced prior art roll shifting is the so-called controlled variable crown, or CVC, rolling in which the work rolls and backup rolls have an S- or bottle-shaped profile and which provides for adjustment of the roll gap profile by bidirectional shifting of the rolls, e.g. in compensation of thermal changes. Disadvantages of the CVC system are that it requires special, asymmetrical roll grinding, and produces an asymmetrical backup roll wear pattern. Moveover, it does not provide sufficient improvement to avoid the need for use of several sets of rolls for rolling a range of sheet or strip of various sizes which can be rolled in a given mill.

Roll crossing is used to modify the roll gap profile for control of the flatness and profile of a rolled workpiece and, as such, competes with roll shifting processes and apparatus such as the CVC system. Presently, roll crossing in rolling mills is performed by actuators that apply displacement forces to the roll chocks in a direction perpendicular to the roll axes. These forces have opposite directions for the chocks of the drive and operator sides of the mill and are applied either directly to the chocks or through equalizing beams. Typical actuators are of a screw-nut or hydraulic mechanism type. The main deficiency of such systems is their complexity. There are three main types of cross-rolling: (1) crossing of the work rolls only; (2) pair crossing—crossing of both work and backup rolls, and (3) crossing of backup rolls only. Crossing of the work rolls only is the least expensive approach; types (2) and (3) are both expensive, although type (2)—pair crossing is the most commonly used.

SUMMARY OF THE INVENTION

The present invention provides an easy and relatively inexpensive way to provide cross-rolling of the work rolls, and avoids or minimizes the formation of ridges caused by worn roll edge grooves, by axial shifting of the work rolls. The invention increases crown control range, avoids asymmetrical roll wear and uses only symmetrical or conventional roll grinding.

These objectives are accomplished in the inventive roll crossing and shifting (RCS) system by making the side surfaces of either the roll chocks or the Mae West blocks of curved shape, e.g. cylindrical, paraboloidal, ellipsoidal, etc., to provide a linear contact with flat surfaced liner plates on the other element, i.e. the chocks or Mae West blocks, at an angle $\beta$. When the rolls are axially shifted, e.g. by hydraulic actuators, by an amount S, the roll chocks follow the slanted path of the liner plates, along the angle $\beta$ between the Mae West blocks of the entry and exit sides of the mill and the roll axis turns through an angle $\alpha$.

DESCRIPTION OF PREFERRED EMBODIMENTS

Figure 1:
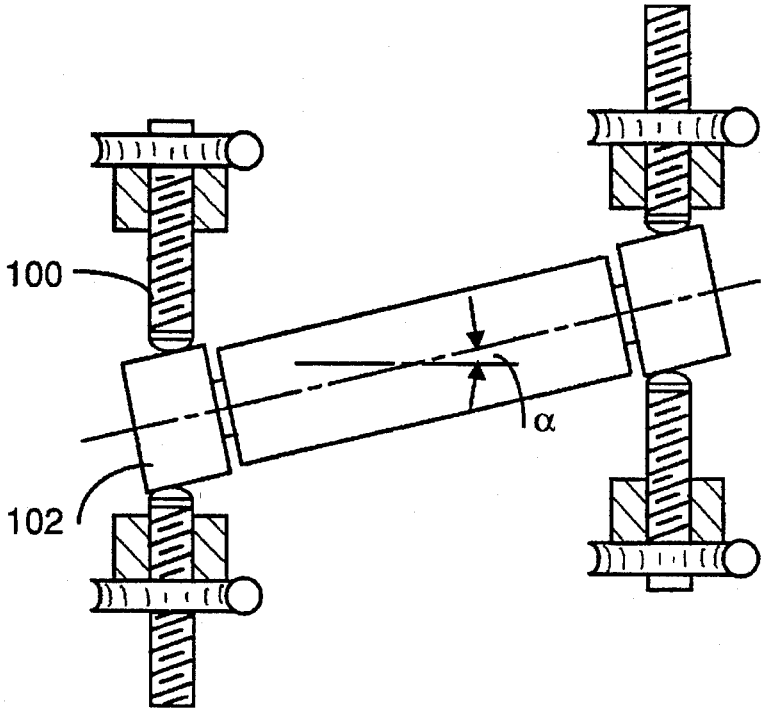
FIG. 1 PRIOR ART
FIG. 1 is a top plan view of one arrangement of the prior art for applying roll crossing displacement forces directly to the roll chocks.

FIG. 1 shows a prior art means for applying roll crossing displacement forces directly, by means of a screw nut actuator 100, to the roll chocks 101, as disclosed in U.S. Pat. No. 1,860,931.

Figure 2:
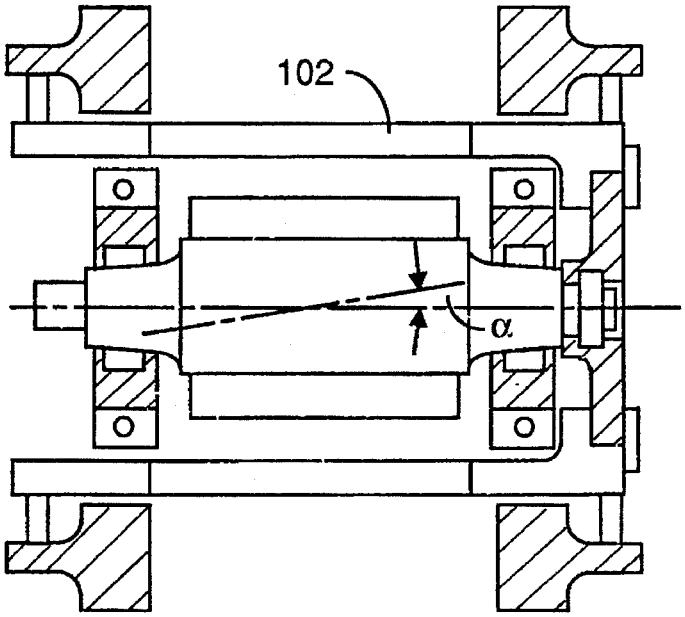
FIG. 2 PRIOR ART
FIG. 2 is a top plan view of another arrangement of the prior art for applying roll crossing displacement forces to the roll chocks through equalizer beams.

FIG. 2 shows a means for applying roll crossing displacement forces to the roll chocks through equalizer beams 102, as disclosed in U.S. Pat. No. 4,453,393.

Figure 3A:
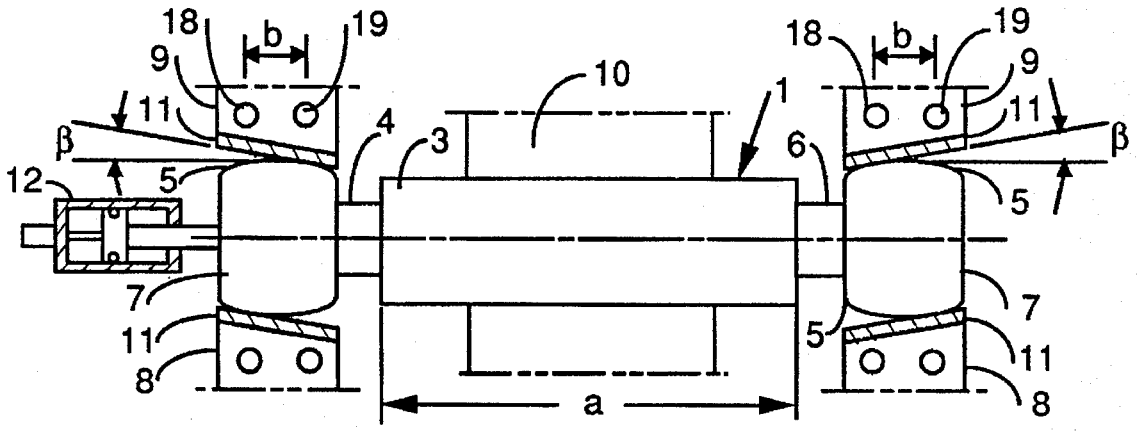
FIGS. 3A–3C are top plan views of a portion of the roll crossing and shifting system of one embodiment of this invention in which the flat, sloped liner plates are on the Mae West blocks and, showing, respectively, the work rolls in uncrossed and the top and bottom rolls in crossed positions.
Figure 3B:
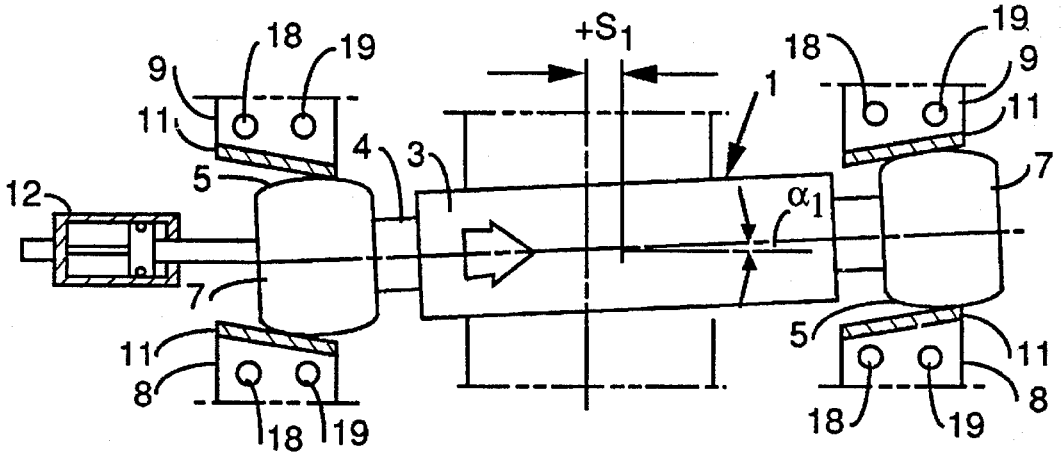
Figure 3C:
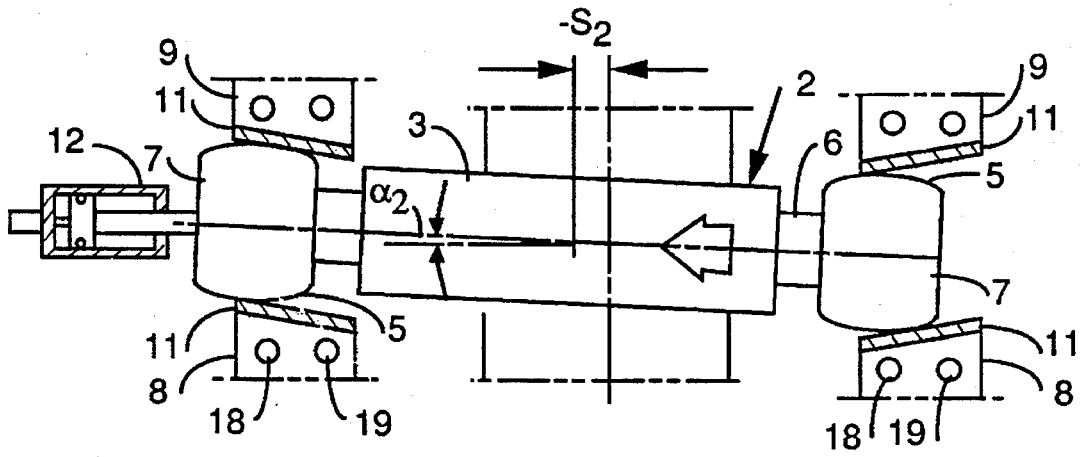

FIGS. 3A–3C show a top work roll 1 and a bottom work roll 2 each having a barrel portion 3 and neck portions 4 and 6 mounted in a chock 7 having a cylindrical surface 5 and adapted to roll a workpiece 10 such as an elongated sheet or strip of metal. Each chock 7 is mounted between an upside Mae West block 8 and a downside Mae West block 9. Each Mae West block is provided with a liner plate 11 having a sloped surface for linear contact with corresponding surfaces 5. Actuators 12 are provided for axially shifting rolls 1 and 2 either to the right or to the left. As shown in FIGS. 3B and 3C, when the rolls are axially shifted in either direction (indicated by the large arrows) a distance S (if to the right, $+S_1$, and if to the left, $-S_2$), the rolls are displaced at an angle $\alpha_1$ or $\alpha_2$ with respect to the normal to the pass line of the mill. This is due to the forces applied to the rolls by chocks 7 as they slide along the slanted contact plate surfaces 11 on the corresponding Mae West blocks. In general, the axial displacements $S_1$ and $S_2$ and the cross angles $\alpha_1$ and $\alpha_2$ of the top and bottom rolls can be different.

Figure 4A:
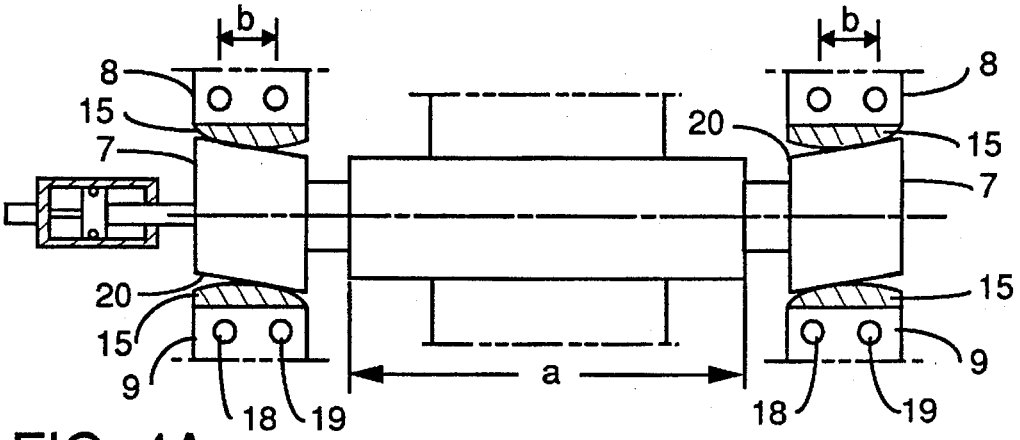
FIGS. 4A–4C are views similar to FIGS. 3A–3C, wherein the flat, sloped surfaces are on the roll chocks and the curved surfaces are on the Mae West blocks.
Figure 4B:
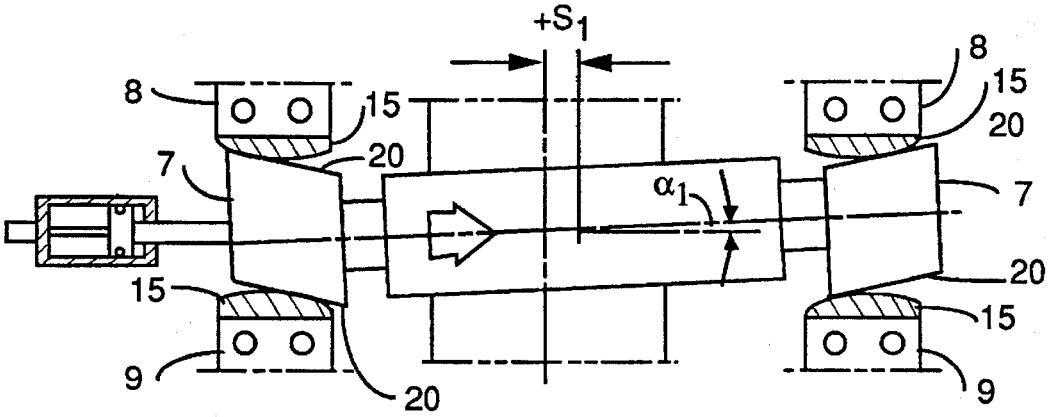
Figure 4C:
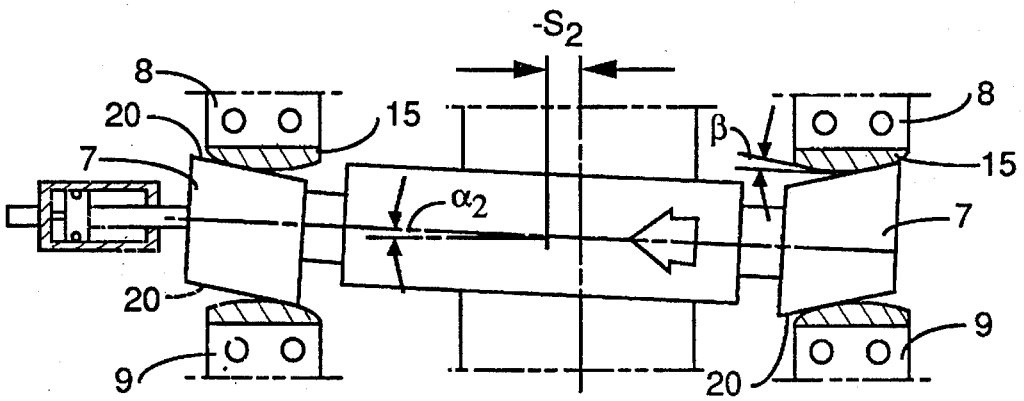

FIGS. 4A–4C are similar to FIGS. 3A–3C, except that the flat liner plate 11 installed on the Mae West blocks 8 and 9 of FIGS. 3A–3C are replaced with a curved liner plate 15 on the Mae West blocks, and the chocks 7 have a flat sloped surface 20. As in the case of the embodiment of FIGS. 3A–3C, roll crossing also occurs in the embodiment of FIGS. 4A–4C when the rolls are axially shifted and the sliding movement between the surfaces 15 and 20 causes displacement of the roll chocks in a direction perpendicular to the roll axis.

Figure 5:
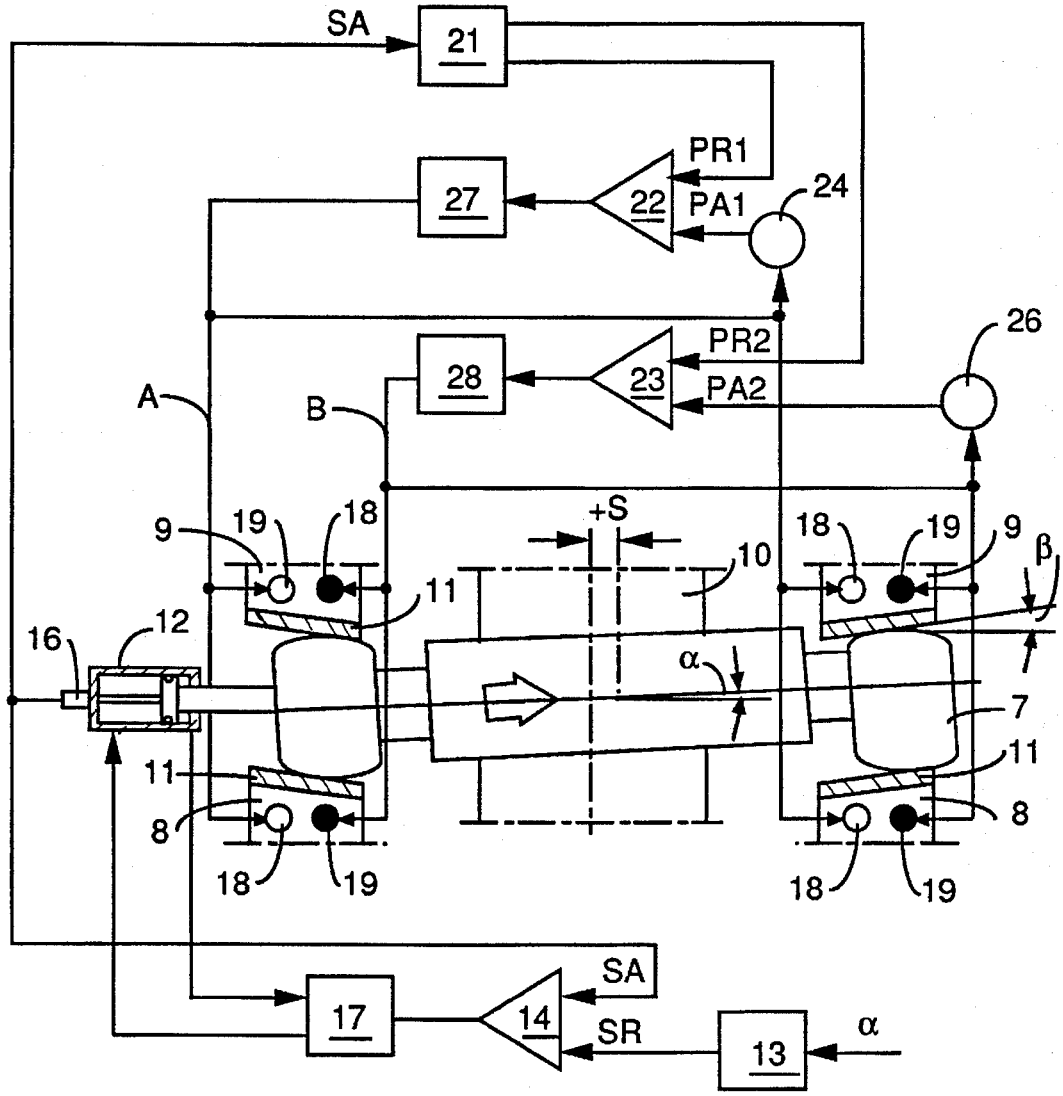
FIG. 5 is a block diagram, in plan view, of one roll of the roll crossing and shifting system of FIG. 3.

The RCS system of the invention is further illustrated in FIG. 5 in which chocks 7 are placed between slanted liner plate surfaces 11 of Mae West blocks 8 and 9. It is to be understood that the embodiment of FIGS. 4A–4C may be substituted. The roll crossing angular position reference $\alpha$ is calculated based on the required strip crown, the width and thickness of the rolled workpiece, roll separating force and the geometry of the mill components. Based on the reference $\alpha$, and also on the slant angle $\beta$, a computer 13 calculates a roll axial shifting reference SR. This reference SR is compared in a roll axial position regulator 14 with actual roll axial position SA that is measured by a position transducer 16 of the hydraulic actuator 12. A difference between SR and SA then is amplified and fed into a servo valve 17 that controls a flow of working fluid into and out of the actuator 12 until a required roll axial displacement S is obtained.

Figure 6:
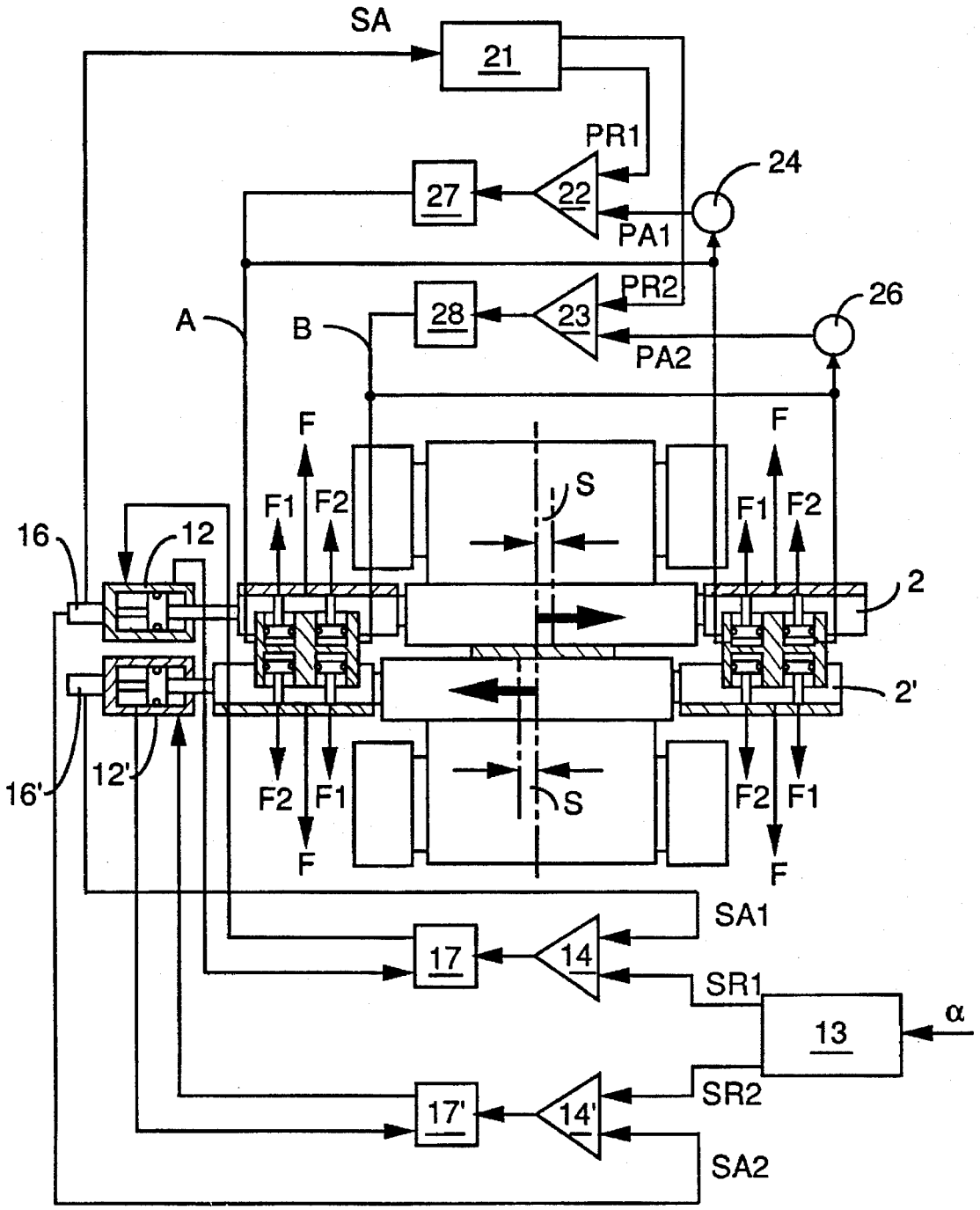
FIG. 6 is a block diagram showing in elevation upper and lower work rolls and related chocks of the general type used in the present invention, and showing the directions of applied roll bending forces as in the present invention.

The roll bending mechanism which acts on each roll chock has two hydraulic cylinders, 18, 19, installed inside each Mae West block. One set of the roll bending cylinders, 18, is connected to a pressure line A and generates a roll bending force F1 (FIG. 6), whereas the other set of cylinders, 19, is fed by a pressure line B and generates a roll bending force F2 (FIG. 6). The invention utilizes a feature as provided in U.S. Pat. No. 4,898,014, the contents of which are incorporated by reference herein, to assure that, during axial roll shifting, the roll bending force always passes through the centerline of the roll chock bearings, as shown in FIG. 5. The hydraulic pressure in the pressure lines A and B is regulated to maintain the following values for the roll bending forces F1 and F2 as a function of the roll shift S:

$$F1=F(0.5-S/b) \quad (1)$$

$$F2=F(0.5+S/b) \quad (2)$$

where

S=roll axial shift b=distance between adjacent roll bending cylinders

F=total roll bending force per one chock.

The signal SA, which represents the actual roll shift S, is received by a microprocessor 21 (FIG. 5) that utilizes Equations (1) and (2) to calculate pressure references PR1 and PR2 for pressure lines A and B respectively. These pressure reference signals are compared by their respective pressure regulators 22 and 23 with actual pressure signals PA1 and PA2 which are measured by pressure sensors 24 and 26. Upon detecting an error signal, the pressure regulators 22 and 23 generate signals that feed servo valves 27 and 28, which regulate the pressure in lines A and B. As long as the roll bending forces F1 and F2 are regulated according to Equations (1) and (2), the total roll bending force F that is applied to each work roll chock will always pass through the centerline of that chock's bearing.

FIG. 6 is similar to FIG. 5, but shows both top and bottom rolls and associated controls wherein the control elements for the lower roll are numbered similarly to those for the top roll as in FIG. 5, but are primed.

The RCS system of the invention may be one of two different types in respect to the direction of roll shifting: (a) bi-directional, or (b) uni-directional. In the bi-directional system, the slant angles $\beta$ of the surfaces of the Mae West blocks, contacting the top and bottom roll chocks at the same side of the mill, have the same sign. Therefore, when the top and bottom rolls are axially shifted in the opposite directions, those rolls also will cross in the opposite directions. In the uni-directional system, the slant angles $\beta$ of the Surfaces of the Mae West blocks, contacting the top and bottom roll chocks at the same side of the mill, have the opposite signs. Therefore, when the top and bottom rolls are axially shifted in the same direction, those rolls will cross in the opposite directions.

There also are two types of the inventive system in respect to symmetry of the roll crossing: (a) symmetrical, and (b) asymmetrical. In the symmetrical system, the Mae West blocks of the drive and operator's sides are slanted with the angles $\beta$ having opposite signs. Therefore, when the roll is axially shifted, one roll chock will move in the direction of rolling while the other chock of the same roll will move in the opposite direction. In the asymmetrical system, the Mae West block of only one side of the mill is slanted, while the other Mae West block remains straight as in a conventional mill stand. Therefore, when the roll is axially shifted, the roll crossing will be provided by displacement of only one roll chock.

Figure 7A:
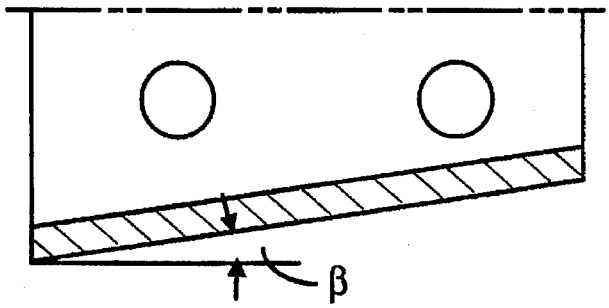
FIGS. 7A–7E are side views of Mae West blocks with various forms of sloping chock-contacting liner plate surfaces.
Figure 7B:
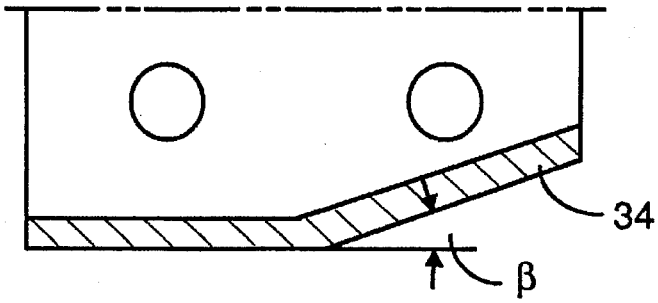
Figure 7C:
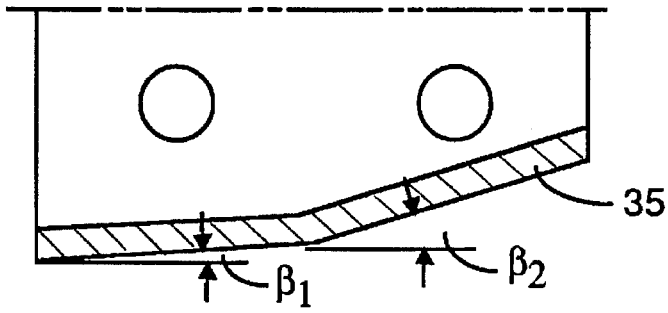
Figure 7D:
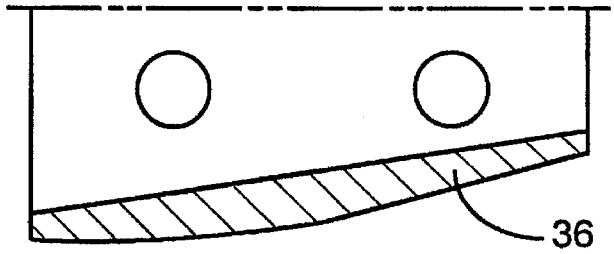
Figure 7E:
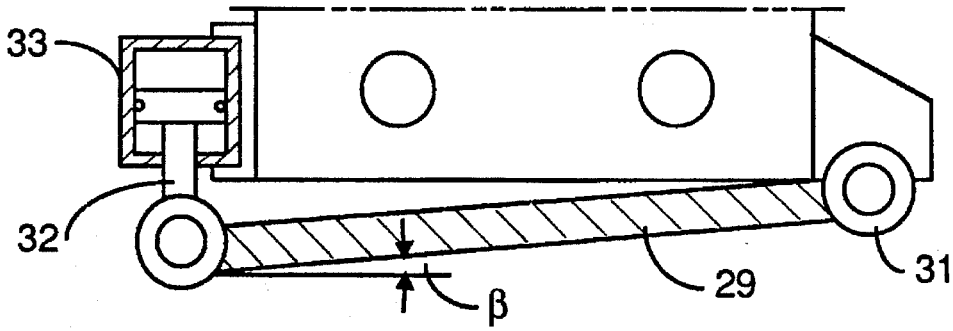

Optionally, the slant angles $\beta$ can be made adjustable with use of an actuator installed inside of the Mae West block. Such an adjustable angle mechanism is shown in FIG. 7E, wherein a slant angle surface element 29 is pivoted at one end, as at 31, to a side of the Mae West block and at the other end to a piston 32 of a piston/cylinder assembly actuator 33. As another option, a slanted surface element 34, as shown in FIG. 7B may have a combined zero and nonzero linear slope to provide two functions: redistribution of roll wear (zero slope zone) and roll crossing (nonzero slope zone). Further, a slanted surface element 35 may comprise a dual slope with angles $\beta_1$ and $\beta_2$, as shown in FIG. 7C to change sensitivity of the equivalent roll crown to the roll shifting stroke, or may comprise an element possessing a continuous curve 36 to provide continuous change of sensitivity of the equivalent roll crown to roll shifting stroke, as shown in FIG. 7D. Although, in these FIGS. and in other FIGS., the slanted or curved liner plate is shown as mounted on the Mae West block, it is to be understood that the outer surfaces of the roll chock may be so slanted or curved, e.g. in cylindrical form, so as to produce, with a flat surface on the Mae West block, a pair of opposed and coacting surfaces which, on axial shifting of the work roll, cause the roll chock to move in a direction perpendicular to the roll axis. It also is to be understood that such opposed and coacting surfaces on the roll chock and the Mae West block both may be curved so long as such roll chock directional movement results from axial roll shifting.

Figure 8:
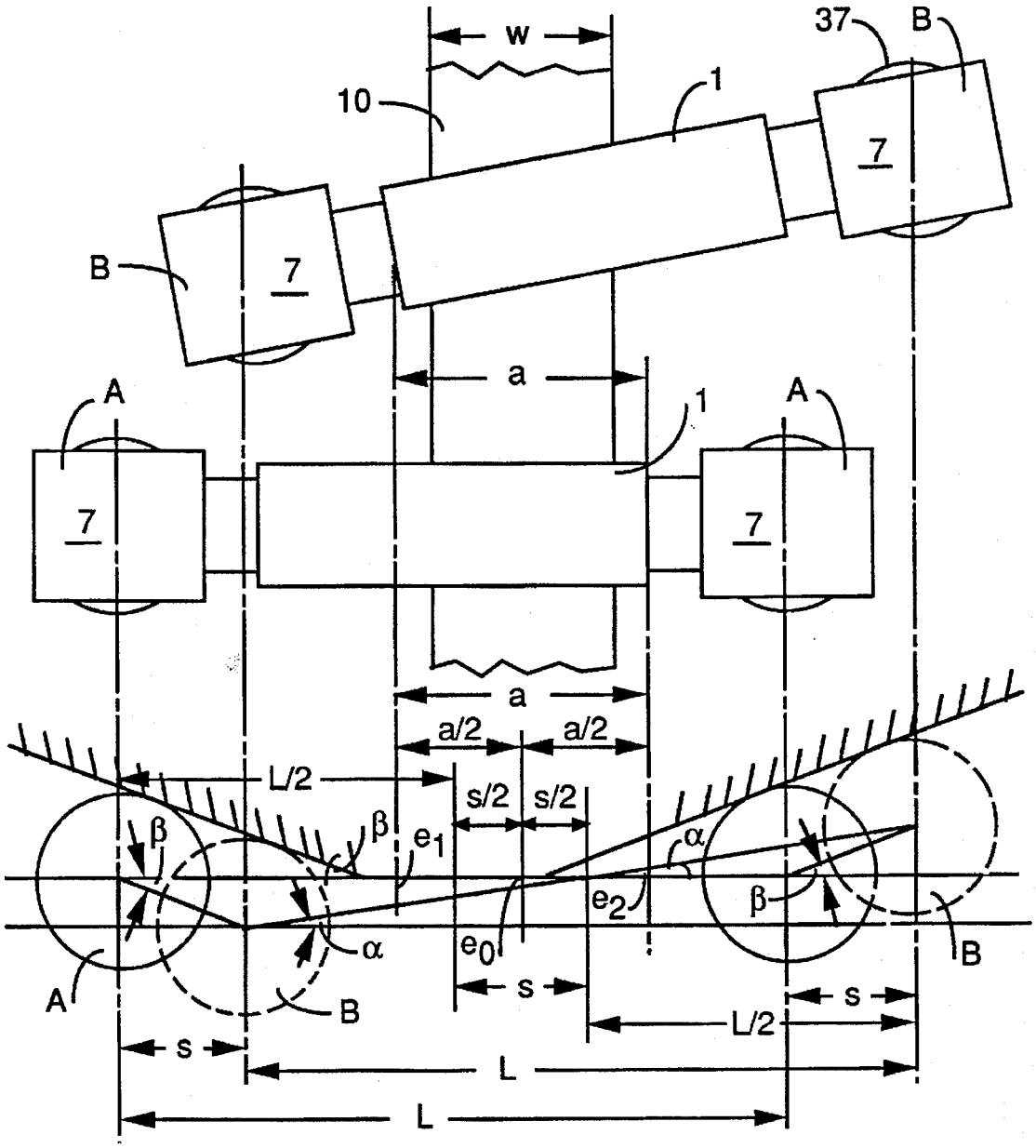
FIG. 8 is a top plan view of the geometry of the present roll crossing and shifting system.
Figure 9:
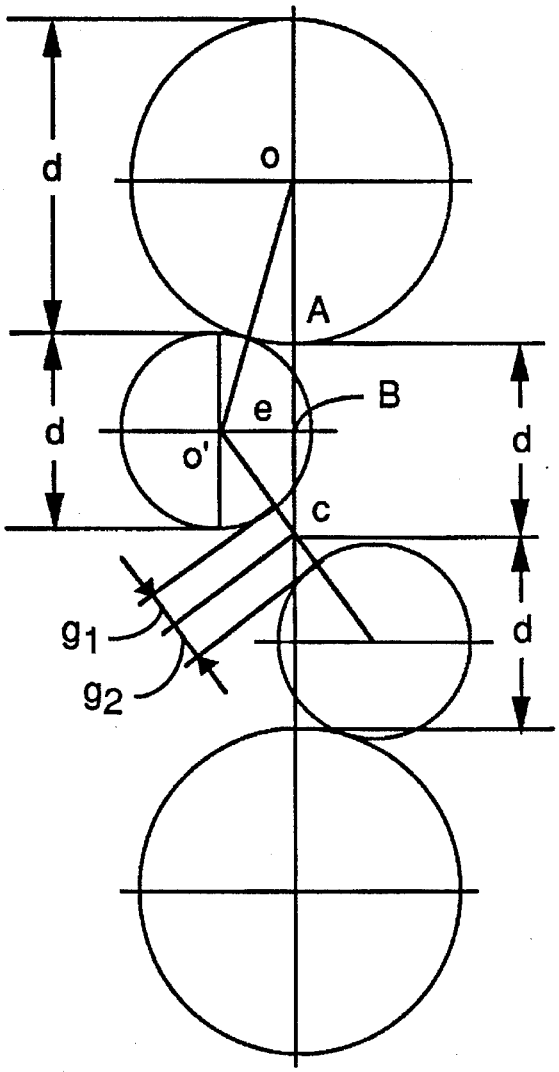
FIG. 9 is a side elevational view of the geometry of the present roll crossing and shifting system.
Figure 10:
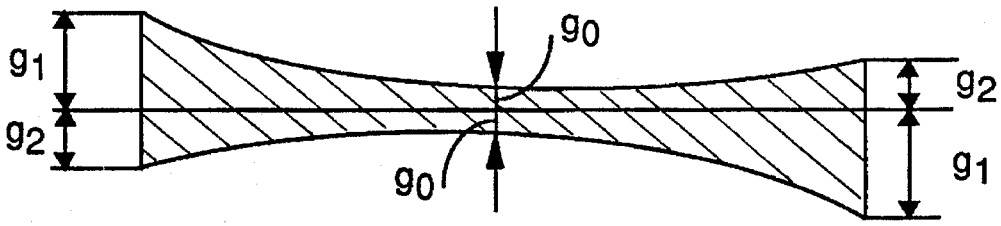
FIG. 10 is a cross-section of a roll gap equivalent profile such as produced with use of the present invention.

FIGS. 8 and 9 illustrate the geometry of the roll crossing and shifting system of the invention, FIG. 8 in plan view and FIG. 9 in side elevational view. FIG. 10 shows a typical roll gap produced by the crossed and shifted rolls in practice of the invention. The following dimensions are depicted.

$\alpha$=roll cross angle corresponding to roll axial shifting s, degrees $\alpha_m$=maximum roll cross angle corresponding to roll maximum axial shifting $s_m$ degrees $\beta$=Mae West (or roll chock) slope angle, degrees a=roll working barrel length c=roll equivalent crown D=backup roll diameter d=work roll diameter $e_o$=roll center cross-section offset $e_1$=roll drive side end cross-section offset $e_2$=roll end operator side cross-section offset $g_o$=gap between roll central cross-section and the mill center c $g_1$=gap between roll operator side end cross-section and the mill center c $g_2$=gap between roll drive side end cross-section and the mill center c L=distance between the bearing centerlines of work roll chocks S=work roll axial shifting distance $S_m$=work roll maximum axial shifting distance From these dimensions, the following further equations are developed.

$$\alpha = \arctan\left[\frac{S}{S_m}\tan\alpha_m\right] \tag{3}$$

$$e_0 = \frac{S}{2}\tan\alpha \tag{4}$$

$$e_1 = \frac{a+S}{2}\tan\alpha \tag{5}$$

$$e_2 = \frac{a-S}{2}\tan\alpha \tag{6}$$

$$g = f(e) = 0.5\sqrt{A^2 - 2AB\left(1 - 2\frac{e^2}{B^2}\right) + B^2} - d/2 \tag{7}$$

$$A = D + 2d;\ B = D + d$$

$$g_0 = f(e_0);\ g_1 = f(e_1);\ g_2 = f(e_2) \tag{8}$$

$$c = g_1 + g_2 + 2g_0 \tag{9}$$

$$\tan\beta = \frac{L}{2S_m}\tan\alpha \tag{10}$$

Figure 11:
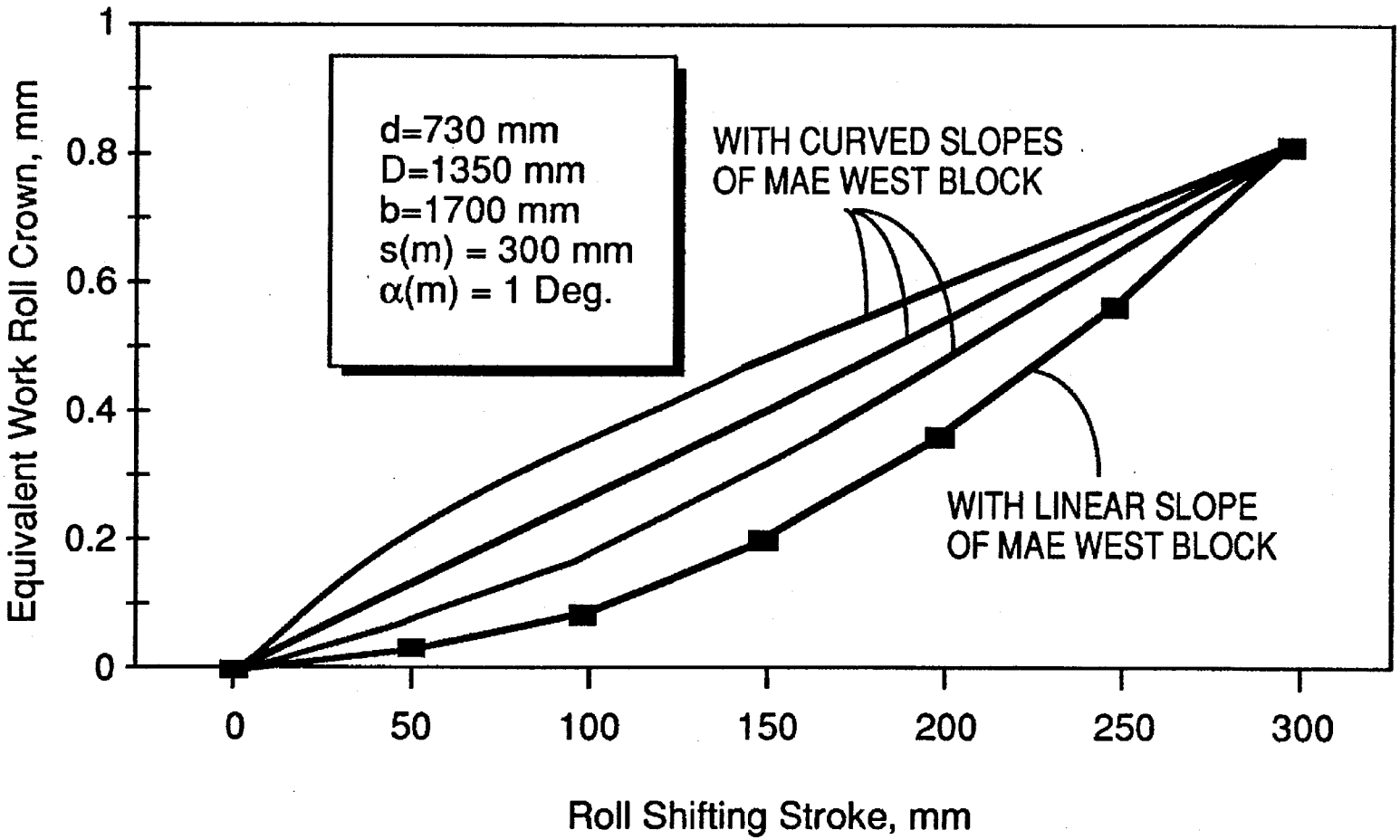
FIG. 11 is a graph relating roll shifting stroke length and equivalent roll crown for several different types of liner plates.
Figure 12:
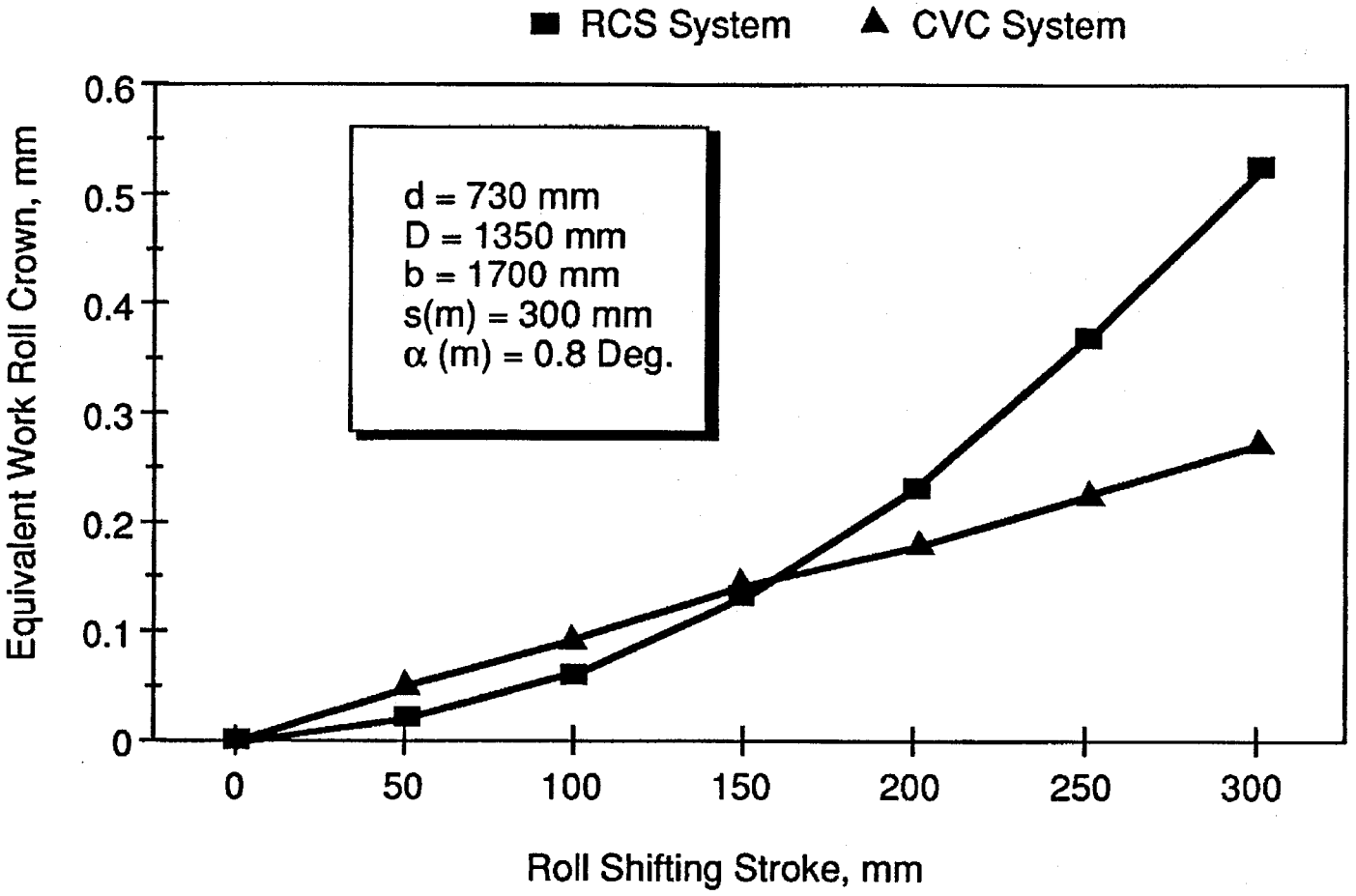
FIG. 12 is a graph showing the relationship between length of roll shifting stroke and the equivalent work roll crown, c, for the present invention and for the CVC system.

These equations are used to calculate the relationship between the equivalent work roll crown c, min. and the distance of the roll shifting stroke. Such relationship for several different types of linear and curved slopes of the Mae West block (or the roll chock) are shown in FIG. 11. Similarly, that relationship for the RCS system of the invention was calculated and compared to the same relationship for the CVC system in FIG. 12, from which is seen that the present system is superior in this respect to the CVC system.

Figure 13:
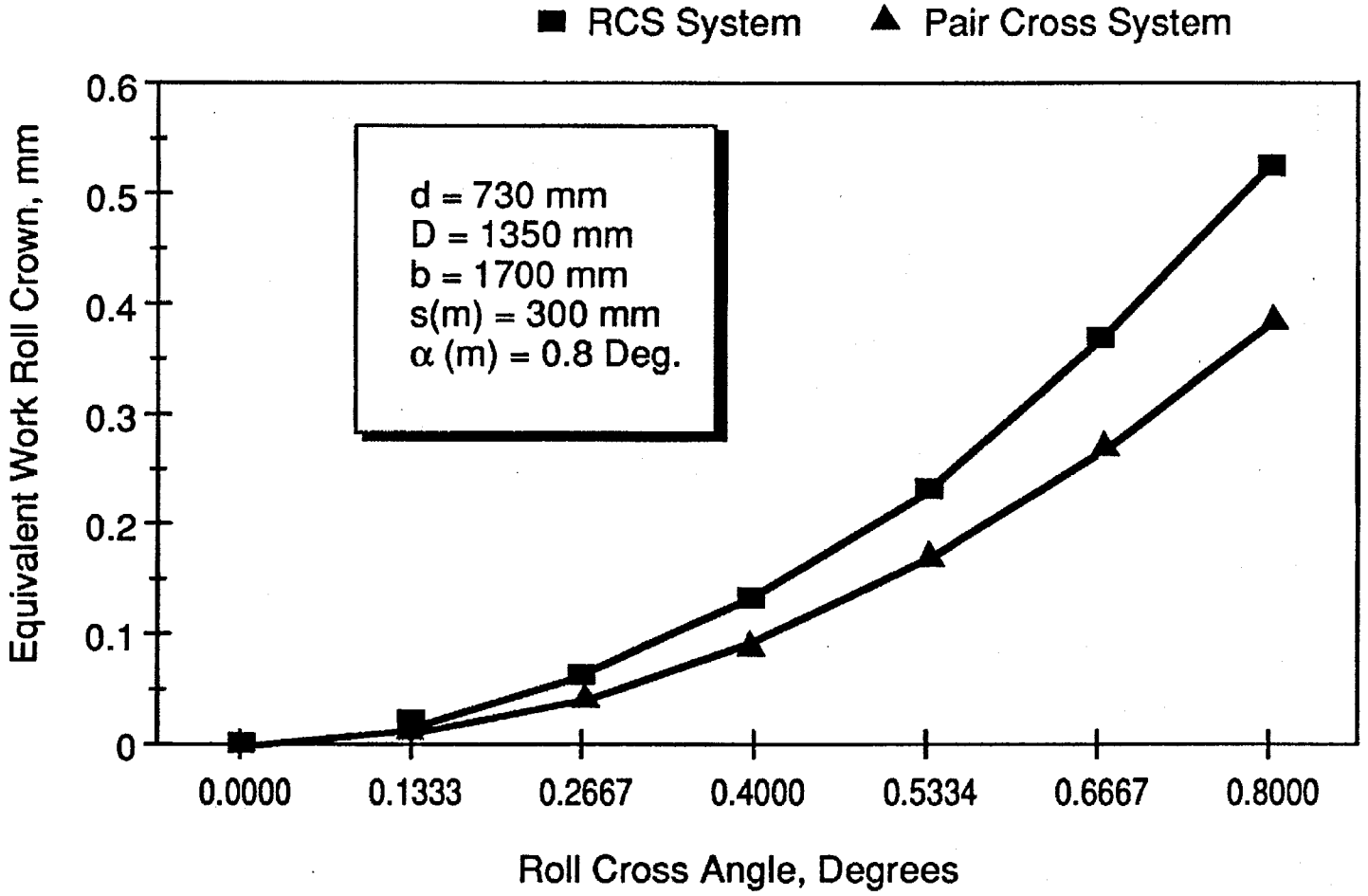
FIG. 13 is a graph relating the roll cross angle and the magnitude of the equivalent work roll crown, for the present invention and for the pair cross system.

Similarly, the relationship between the equivalent work roll crown and the roll cross angle, degrees, was calculated and compared with the same relationship for the roll pair cross system (FIG. 13). From FIG. 13 it can be seen that the present system is superior in this respect to the pair cross system of the prior art.

Figure 14:
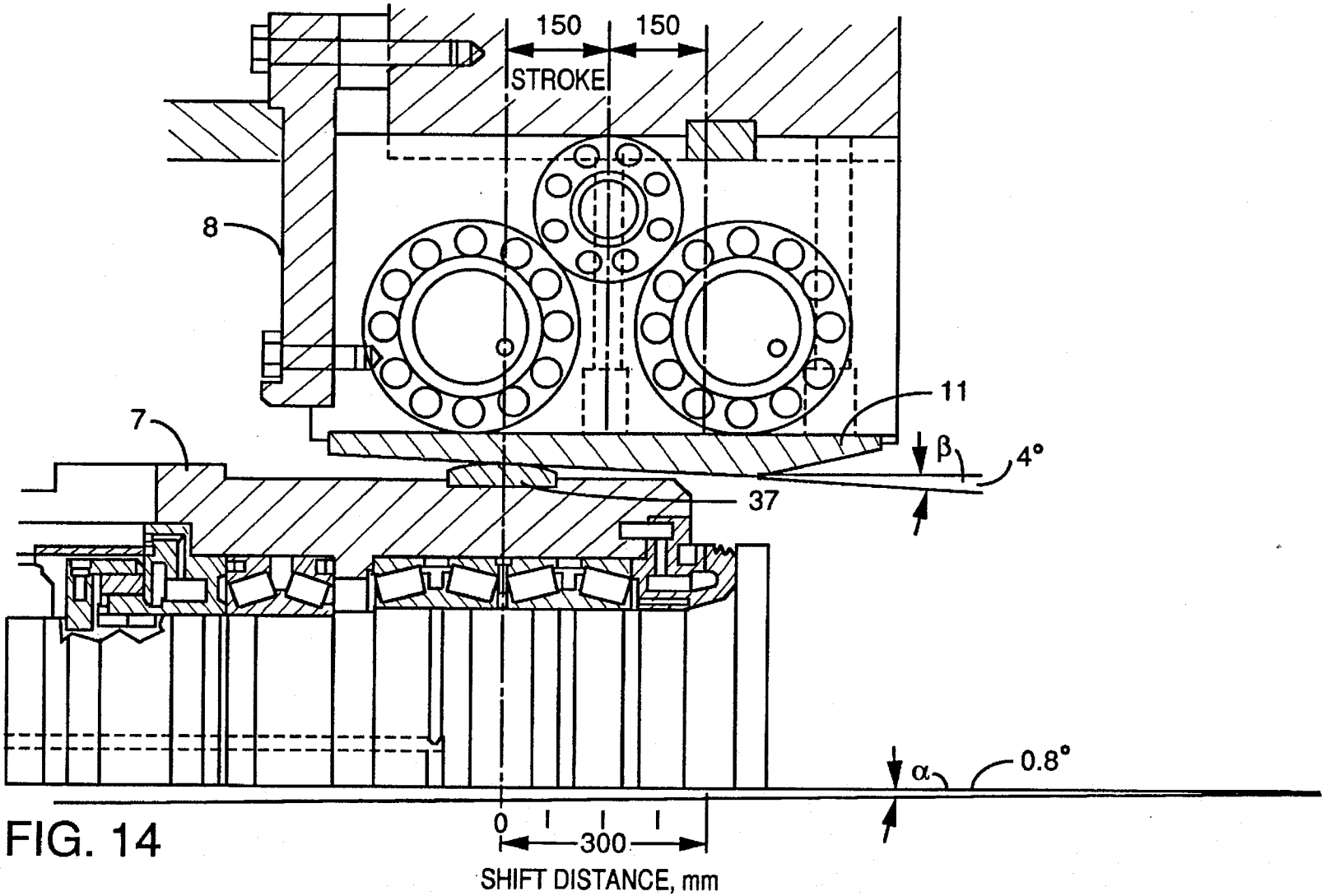
FIG. 14 is a side view of a chock and related Mae West block, with no shift displacement of the chock relative to the Mae West block.
Figure 15:
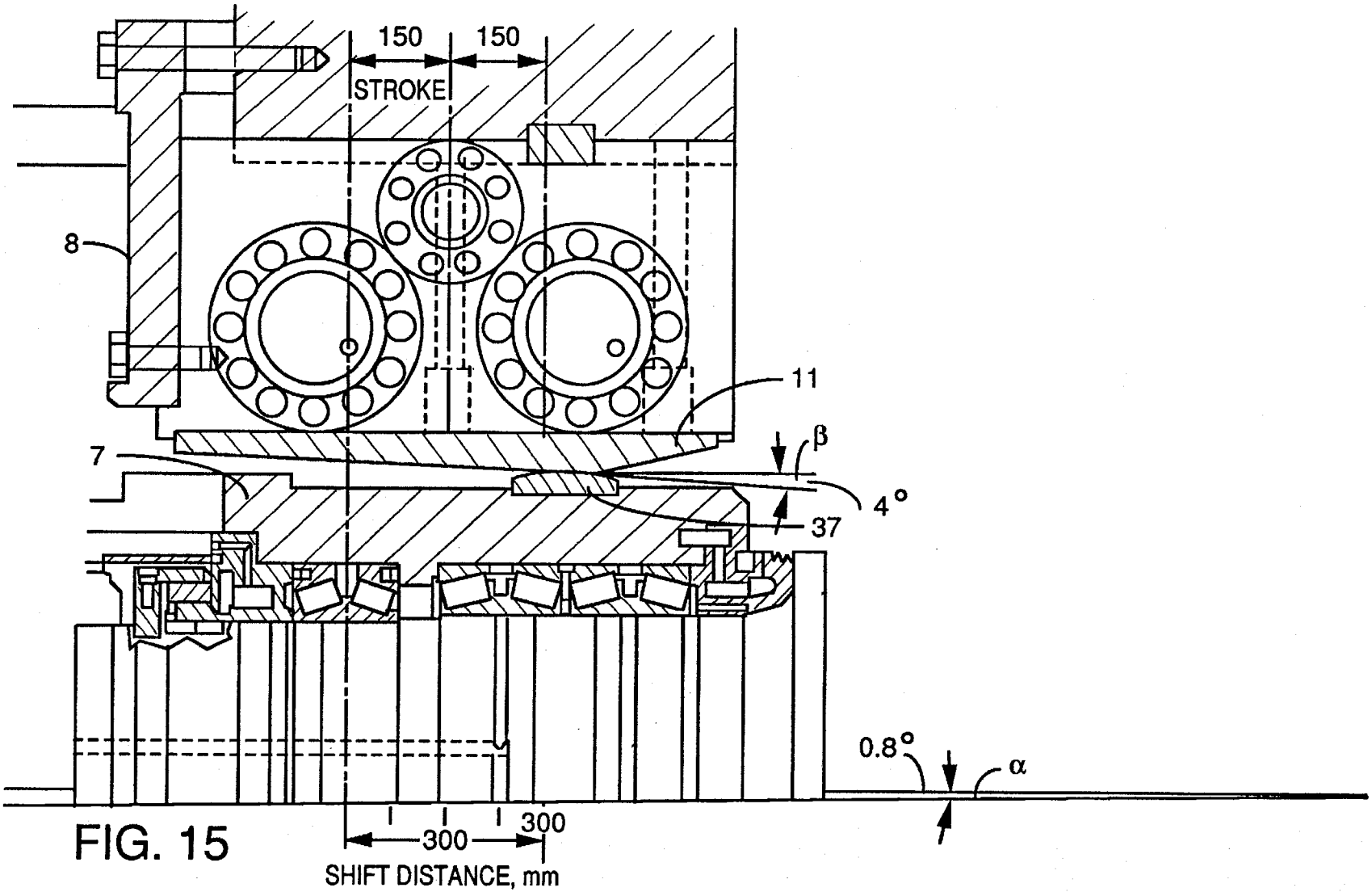
FIG. 15 is a side view of a chock and related Mae West block, showing full (300 mm) relative shift displacement between those elements.

FIG. 14 shows, partly in cross-section, the chuck 7 and Mae West block 8 with liner plate 11, before the work roll is axially shifted. FIG. 15 is a similar view after a full, 300 mm. shift of the work roll. As these FIGS. show, the angle $\beta$ is a small angle, preferably less than 5°. In the case of a 4 degree angle as shown in these FIGS., shifting of the work roll produces an angle $\alpha$ of about 0.8 degrees.

As shown in FIGS. 14 and 15, the chocks 7 may be provided with a cylindrical insert 37 for sliding contact with the contact liner plates 11 of the Mae West blocks 8.

Use of the system of the invention provides a means for distributing roll wear, minimizing workpiece surface defects as a result of roll wear, and controlling the flatness and profile of the workpiece being rolled, to an extent superior to prior art systems.

The imprint of roll wear is more pronounced in downstream stands, for example, stands 5–7 of a 7-stand mill, and it is, therefore, more important to use the roll shifting, without crossing, to redistribute roll wear in downstream mill stands. Since local roll wear in the upstream stands, e.g. stands 1–3 of a 7-stand mill, does not produce strip surface defects, roll shifting, with roll crossing, should be used on those stands to increase crown control range. In the intermediate stands, e.g. stand 4 of a 7-stand mill, a dual purpose roll shifting, as in FIG. 7B, should be used. Depending on size and type of rolled material, roll shifting will be used either to redistribute roll wear or to produce roll crossing and thus to increase crown control range.

What is claimed is:

1. An improved roll shifting and crossing system comprising a rolling mill housing, at least one pair of upper and a lower work rolls having roll necks mounted in chocks each of which is supported by a pair of upside and downside Mae West blocks mounted in the housing, each of said chocks and the associated Mae West blocks having between them a pair of opposed contacting surfaces having a variable slope and defining an angle $\beta$ with respect to the roll axis and which surfaces, upon axial shifting of the work roll, causes at least one roll chock of each roll simultaneously to move in a direction perpendicular to the roll axis resulting in crossing of each pair of rolls at an angle, $\alpha$, to the pass line of the mill, and means to axially shift the work rolls.

2. A system according to claim 1, wherein the angles $\beta$ of the contacting surfaces between the Mae West blocks and the top and bottom roll chocks at the same side of the mill have the same sign, whereby, when the top and bottom rolls are axially shifted in the opposite directions, the rolls will cross in opposite directions.

3. A system according to claim 1, wherein the angles $\beta$ of the contacting surfaces between the Mae West blocks and the top and bottom roll chocks at the same side of the mill, have opposite signs, whereby, when the top and bottom rolls are axially shifted in the same direction, the rolls will cross in opposite directions.

4. A system according to claim 1, wherein the contacting surfaces between the Mae West blocks and the roll chocks of the drive and operator's sides of the mill are slanted with angles $\beta$ having opposite signs, whereby, when a roll is axially shifted, one roll chock will move in the direction of rolling while the other chock of the same roll will move in the opposite direction.

5. A system according to claim 1, wherein the contacting surfaces between the Mae West block and one associated roll chock of one side of the mill is slanted at an angle β and the angle β between the Mae West block and the other roll chock is zero, whereby, when a roll is axially shifted, roll crossing is provided by displacement of only the one roll chock.

6. A system according to claim 1, further including an actuator for adjusting the angle β between the contacting surfaces of the Mae West blocks and the corresponding roll chocks.

7. A system according to claim 1, wherein the contacting surfaces between the Mae West block and the roll chock comprise a first, smaller angle $\beta_1$ for fine adjustment of the angle α on roll crossing and a second, larger angle $\beta_2$ for gross adjustment of the angle α.

8. A system according to claim 1, wherein the contacting surfaces between the Mae West block and the roll chock comprise a combined zero and nonzero linear slope in order to provide the combined functions of redistribution of roll wear and roll crossing.

9. A system according to claim 1, wherein one of the contacting surfaces between the Mae West block and the roll chock is a continuous curve.

10. A system according to claim 1, wherein the opposed contacting surfaces define an angle β, a first component of which is zero and a second component of which is other than zero.

11. A system according to claim 1, wherein the contacting surface of the Mae West block is a flat sloped surface and the surface of the roll chock is a curved surface.

12. A system according to claim 1, wherein the contacting surface of the Mae West block is a curved surface and the surface of the roll chock is a flat sloped surface.

13. A system according to claim 1, further including a pair of hydraulic cylinders installed inside each Mae West block, wherein one of the cylinders is connected to a first pressure line and generates a first roll bending force F1 acting on an associated roll chock, and the other cylinder is connected to a second pressure line and generates a second roll bending force F2 acting on an associated roll chock.

14. A method for operating a system according to claim 13, comprising regulating hydraulic pressure in the first and second pressure lines in accordance with the relationships:

$$(1) F1=F(0.5-S/b) \text{ and}$$

$$(2) F2=F(0.5+S/b)$$

where S is the roll axial shift distance, b is the distance between adjacent roll bending cylinders, and F is the total roll bending force exerted on one chock.

15. A system according to claim 13, wherein the means for axially shifting a work roll is an hydraulic actuator provided with a position transducer, and further includes a computer for calculating a roll axial shifting reference based on the angles β and α, a roll axial position regulator, a first servovalve for controlling flow of fluid into and out of the actuator, a microprocessor, a pair of pressure regulators, a pair of pressure sensors, and second and third servovalves for regulating pressure in the first and second pressure lines.

16. A method of operating the system according to claim 15, comprising: generating a roll axial shifting reference signal, in the roll axial position regulator comparing the roll axial shifting reference signal to an actual roll axial position signal measured by the position transducer of the hydraulic actuator, generating and amplifying a difference signal between the roll axial shifting reference signal and the actual roll axial position signal and feeding such amplified difference signal into the first servovalve to control flow of hydraulic fluid into and out of the hydraulic actuator until a required roll axial displacement is attained.

17. A method according to claim 16, further comprising inputting the actual roll axial shifting reference signal into the microprocessor and there utilizing equations (1) and (2) of claim 14 to calculate first and second pressure reference signals for the first and second pressure lines, comparing the first and second pressure reference signals by means of the pair of pressure regulators with actual pressure signals measured by the pair of pressure sensors, and, upon detecting an error signal, generating in the pressure regulators signals that are fed to the second and third servovalves which regulate pressure in the first and second pressure lines.

18. A method of roll axial shifting and crossing comprising mounting at least one pair of upper and lower work rolls in chocks enclosing necks of each roll and supported by a pair of upside and downside Mae West blocks, said roll chocks and associated Mae West blocks having opposed contact surfaces having a variable slope and defining an angle β with respect to the roll axis, mounting each roll chock with the contact surface thereof between the contact surfaces on the associated Mae West blocks, axially shifting the rolls and simultaneously crossing the rolls through an angle α by means of forces acting between the contact surfaces of the chocks and the Mae West blocks.

* * * * *